US009707420B2

(12) United States Patent
Sinkaruk

(10) Patent No.: US 9,707,420 B2
(45) Date of Patent: Jul. 18, 2017

(54) RAPPELLING-ASCENDING APPARATUS FOR CLIMBING

(71) Applicant: Andrej M. Sinkaruk, Klaipeda (LT)

(72) Inventor: Andrej M. Sinkaruk, Klaipeda (LT)

( * ) Notice: Subject to any disclaimer, the term of this patent is extended or adjusted under 35 U.S.C. 154(b) by 55 days.

(21) Appl. No.: 14/884,742

(22) Filed: Oct. 15, 2015

(65) Prior Publication Data

US 2017/0106219 A1 Apr. 20, 2017

(51) Int. Cl.

| | |
|---|---|
| ***A62B 1/20*** | (2006.01) |
| ***A62B 35/00*** | (2006.01) |
| ***A62B 1/14*** | (2006.01) |

(52) U.S. Cl.

CPC ..... *A62B 35/0037* (2013.01); *A62B 1/14* (2013.01); *A62B 35/0081* (2013.01)

(58) Field of Classification Search

CPC ..... F16D 63/008; A62B 1/14; B66D 5/16
USPC ..... 188/65.1, 65.4, 65.5; 182/191, 192, 193
See application file for complete search history.

(56) References Cited

U.S. PATENT DOCUMENTS

| | | | | | |
|---|---|---|---|---|---|
| 4,576,248 | A * | 3/1986 | Marom | A62B 1/14 | 182/5 |
| 4,596,314 | A * | 6/1986 | Rogelja | A62B 1/14 | 182/5 |
| 5,054,577 | A * | 10/1991 | Petzl | A62B 1/14 | 182/193 |
| 5,597,052 | A * | 1/1997 | Rogleja | A62B 1/14 | 182/193 |
| 5,850,893 | A * | 12/1998 | Hede | A62B 1/14 | 182/193 |
| 5,954,153 | A * | 9/1999 | Rogelja | A62B 1/14 | 182/5 |
| 8,348,016 | B2 * | 1/2013 | Lewis | A62B 1/14 | 182/192 |
| 2003/0075392 | A1 * | 4/2003 | Rogelja | A62B 1/14 | 188/65.5 |
| 2006/0070809 | A1 * | 4/2006 | Barzilai | E06B 7/28 | 182/193 |

* cited by examiner

*Primary Examiner* — Nicholas J Lane
(74) *Attorney, Agent, or Firm* — Patentagar PLLC; Alexander Rabinovich

(57) ABSTRACT

A rappelling-ascending apparatus for rock-climbing and industrial alpinism comprises an all-metal body defined by a front, a rear, and two lateral sides, a clamping element, and a handle. The body is made with a widening in its lower portion and two cuts along the lateral sides, the first being lengthwise the widening, the second being lengthwise the side and forming flanges. The handle is spring-biased and rotatably mounted on an axis between the front and rear sides. It comprises a two-prong friction fork on one side thereof relative to the axis, the friction fork being located on the side of the first cut. There is a ring on the opposite side of the handle and on the side of the second cut. The clamping element is mounted on the handle facing depressions in the flanges and adapted to hold a rope passing along the flanges when pressed against the rope.

15 Claims, 2 Drawing Sheets

RAPPELLING-ASCENDING APPARATUS FOR CLIMBING

BACKGROUND OF THE DISCLOSURE

Field of the Disclosure

The present disclosure pertains to rock climbing and industrial alpinism (steeplejacking) and can be used for rappelling or ascending a climber, as well as for tightening polyspasts.

Description of the Related Art

The best-known apparatus for rappelling is a FIGURE EIGHT (see, for example, Ref. 1) which comprises two rings inseparably connected to each other, one of the rings being 1.5 times smaller than the other, the inner diameter thereof being up to 50 mm.

The FIGURE EIGHT has several deficiencies. During the rappelling, a rope twisting occurs, and it is difficult enough to position the loose end of the rope during stops.

To solve the problem of positioning the loose end, a FIGURE EIGHT with ears is used. This type of FIGURE EIGHT, unlike a conventional one, additionally comprises two ears on the sides of the large ring, the ears being connected to each other and attached to a pin inseparably connected to the large ring. Still, the twisting of the loose end of the rope remains a drawback of the FIGURE EIGHT with ears.

Another known apparatus for rappelling is a Gri-Gri (see, for example, Ref. 2), including a body, which comprises a flywheel, including a cam, the flywheel being connected to a lever. In the Gri-Gri, the rope rounds the circular cam-like flywheel. When loaded, the rope turns the flywheel around its axis, which presses it to the body and thus blocks rappelling. The turning angle of the lever can be used to control the speed of paying out the rope through the apparatus, and to unblock it.

The Gri-Gri apparatus is automatically blocked under a load and does not twist the rope. During the operation, however, a dirty rope can hinder the rappelling, and the rappelling is impossible using two ropes.

Also known in the art is a plurality of modifications of descender apparatuses (see, for example, Ref. 3) that have two pulleys placed into a frame of two plates, one of the plates being rotatable around the axis of one of the pulleys to be able to put in the rope. In a closed position, the rotatable plate is kept in place by a latch.

To increase the safety and comfort of rappelling, descenders are used which, unlike those described above, are equipped with a control and unblocking handle adapted to regulate the force of friction of the rope. Main disadvantages of these descenders include their inability to function with two ropes, the impossibility to remove the rope without using additional clamp, and the impossibility of using them for ascension.

The closest to the present disclosure in technical essence is a clamp (see, for example, Ref. 4), which comprises a hollow all-metal body with free end faces, a partially open base, and one edge, the body having a hole in the upper portions thereof to fix the axis of a clamping element (a cam) with notches. There is a special aperture for a snap-hook in the upper portion of the body, and there is a hole for a foot pedal in the lower portion thereof.

The deficiencies of the prototype involve the impossibility of using it with two ropes, its structural limitations that allow using it only for ascension, as well as the impossibility of controlling the force of friction of the rope.

BRIEF SUMMARY OF THE DISCLOSURE

The object of the present disclosure is providing a construction of an apparatus that, being universal, can be used for both rappelling and ascending.

The technical result lies in providing capabilities to work with two ropes, to regulate the force of friction of the rope, and to provide for easy detaching the apparatus from the strained ropes.

To accomplish the above-mentioned technical result, the apparatus according to the present disclosure comprises an all-metal body defined by a front, a rear, and two lateral sides with open end faces and a hole for a first fastening element, and a clamping element with notches, the all-metal body is made oblong and is provided with a widening at a lower portion thereof, a first cut of about the height of the widening is made in one of the lateral sides along the widening, whereas a second cut is made in the opposite lateral side along the whole lateral side, the second cut forming two flanges; a handle is provided comprising a friction fork with two vertical prongs on one side of the handle, made in the central portion of the handle is the hole for the first fastening element and holes for the clamping element and a spring, and the opposite side of the handle includes an oval ring; a hole for the first fastening element is made in a lower portion of the widening; a hole for a second fastening element is made in the lower portion of the widening, higher than the hole for the first fastening element and closer to the first cut, the second fastening element including a handle fastening axis and comprising the spring; the notches of the clamping element being placed adjacent to the second cut, each of the flanges being made with a depression.

Additionally, surfaces of the body and oval ring can be coated for protection.

Still additionally, the first fastening element is provided with a protective cylinder.

Yet additionally, the ring is provided with two holes therein.

DETAILED DESCRIPTION OF THE DISCLOSURE

Figure 1:
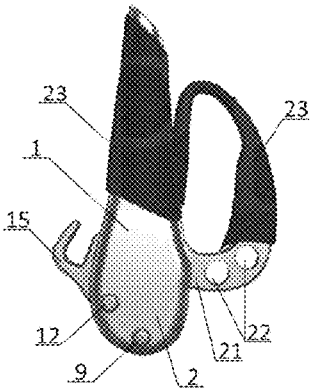
FIG. 1 presents the front view of the apparatus.
Figure 2:
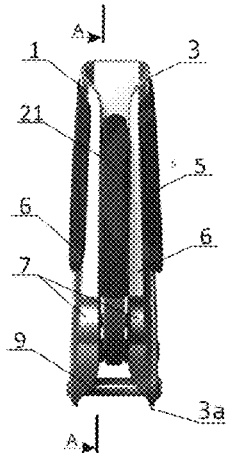
FIG. 2 shows the side view of the apparatus.
Figure 3:
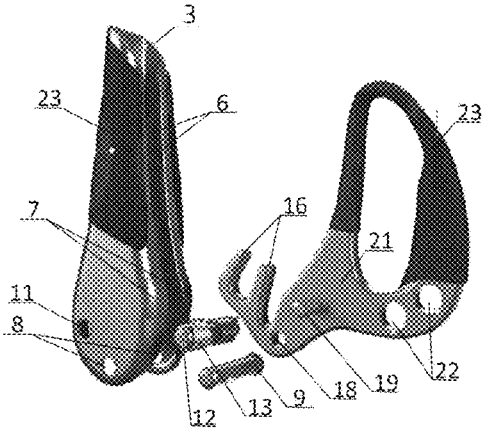
FIG. 3 illustrates the apparatus disassembled.
Figure 4A:
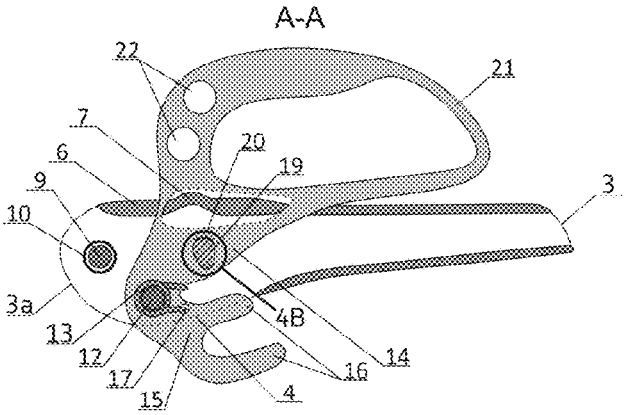
FIG. 4A depicts the cross-section A-A of FIG. 2.
Figure 4B:
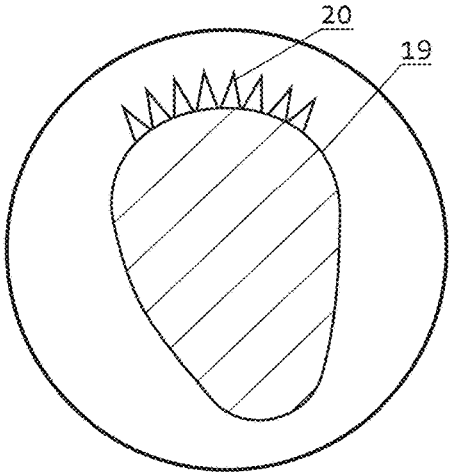
FIG. 4B shows an enlarged view of a portion of FIG. 4A.

The apparatus comprises an all-metal body 1 defined by a front a rear and two lateral sides. The body has a widening 2 in a lower portion thereof. End faces 3 and 3*a* of the body 1 are made open. A cut 4 is made along the widening 2 on one of the lateral sides of the body 1, while a complete cut 5 is made along an opposite lateral side. The complete cut 5 forms a pair of flanges 6, on each of which a recession 7 is made. In the lower portion of the body 1, an opening 8 is made for a first fastening element 9, which can be provided with a protective cylinder 10. Additionally in the body 1, an opening 11 is made for a second fastening element 12, which is provided with a spring 13 and presents a mounting axis for a handle 14.

The handle 14 comprises a friction fork 15 with two vertical prongs 16. In its middle portion, the handle 14 has a hole 17 to hook a spring, an opening 18 for the second fastening element 12 and an opening for a clamping element 19 with notches 20. Situated from the opposite side of the handle 14 relative to the friction fork 15 is an oval ring 21 with a pair of openings 22. The openings 22 are for the attaching of the apparatus to the harness of the alpinist. The upper portion of the body 1 and the ring 21 are supplied with a protective coating 23.

The apparatus functions in the following manner.

Before rappelling from the upper site, a climber guides one or two ropes 24 (in FIG. 5) through the cut 5 into the inner surface of the body 1 and places them between the clamping element 19 and the recession 7 in the flanges 6, and also between the protective cylinder 10 and the flanges 6. By means of the clamping element 19 and notches 20, the spring 13 presses the ropes 24 to the recession 7 and flanges 6. After loading the ropes 24, the notches 20 safely hold the climber. To decrease the force of friction while rappelling, the climber pushes the ring 21 in the direction of a curved arrow in FIG. 5, which ring presses the notches 20 out of the ropes 24. The ropes are secured by means of slings and snap-hooks. The sling (of textile/steel) is wrapped around a structure (tube/beam/anchor), and the ends of the sling are then connected via a snap-hook with a loop made at the end of the rope. Also possible is connecting the rope to such fixtures as anchors or heavy load by the use of a knot thereon and a snap-hook.

Figure 5:
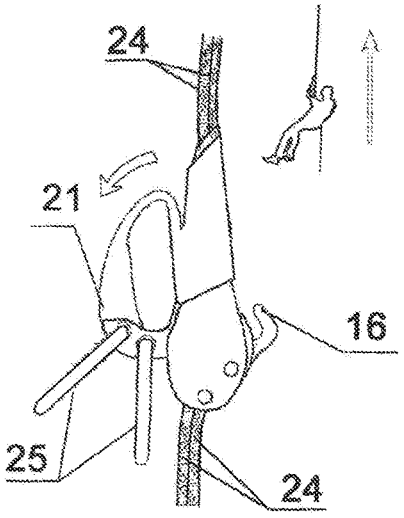
FIG. 5 illustrates methodology of ascending.
Figure 6:
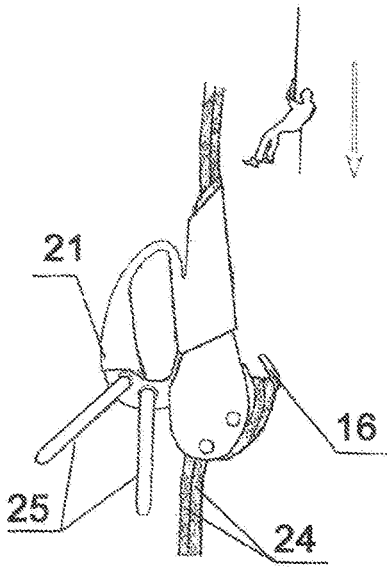
FIG. 6 illustrates methodology of rappelling and locking a free end of a rope.

Before moving up (FIG. 6), the climber inserts a snap-hook 25 in each of the openings 22 and connects the snap-hooks with a harness (not shown). Above the apparatus, he/she installs a second such apparatus or a standard clamp on the main rope and connects it with a footstep (not shown) which is connected by a snap-hook to a hole in the handle 14. For moving up, the climber inserts a boot tip into the footstep made as a band loop, straightens the leg, and moves the lower apparatus along the rope 24 upward. Then, the climber eases the leg and moves the upper apparatus up the rope 24. Alternatively, only one apparatus can be used for ascension, and instead of using a footstep, a rope poking out below the apparatus can be used. In this case, the ascension is performed by means of hanging ("hovering") on the rope with the use of the apparatus secured to the harness. Then, a loop is formed of the loose end of the rope(-s) and the end is manually pressed against the strained rope above the apparatus. The bent leg (or both legs) is inserted into the loop, and through unbending the leg and drawing the body up by hands gripping the rope, the body, together with the apparatus, moves up along the strained rope fixing itself in a higher position. The process repeats itself until a certain height is reached. The arrow in FIG. 5 next to the ring 21 shows the direction in which the handle is to be loaded. In FIG. 6, illustrating the ascension, it is necessary to hang on the handle to press it of the body. In FIG. 5, illustrating the rappelling, the handle should be pressed towards (into) the apparatus, thus freeing the ropes from the clamping element 19.

For reliable fixation of the apparatus on the rope, the loose ends of the rope 24 are inserted into a loop of the rope 24 through the ring 21, and the loop is then placed on the top part of the ring.

Figure 7:
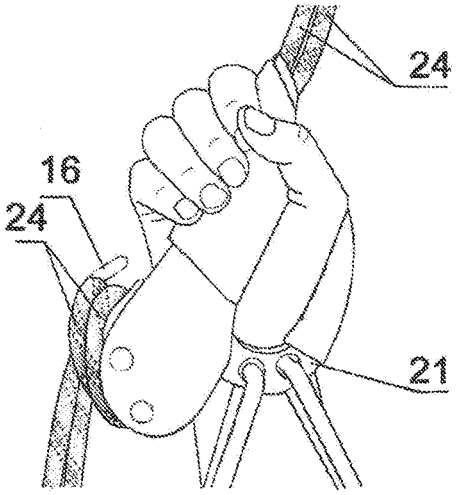
FIG. 7 shows an example of the alpinist's grip.

In FIG. 7, the positioning of the climber's hands are shown while he/she is utilizing the device. The structure of the device allows it to be used like a standard clamp as the polyspast is being strained and it provides easy removal of the apparatus from the strained ropes.

When used for industrial alpinism, the apparatus is supposed to be used with two ropes and two anchor points therefor, the ropes have to be secured by means of slings and snap-hooks, whereas for sporting alpinism it is admissible to secure ropes directly to anchors.

Figure 8:
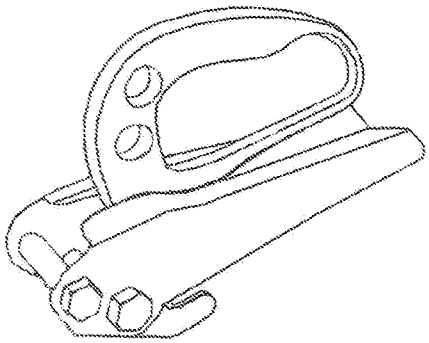
FIG. 8 illustrates a general view of a prototype unit of the apparatus.

A thorough model (see FIG. 8) of the rappelling and ascending system according to the present disclosure was tested and confirmed the desired result and positive technical effects, which present themselves as follows.

Utilizing the apparatus for either rappelling or ascension, as well as for protection and self-protection is enabled.

Using the apparatus as a clamp, while the polyspast is strained, is made possible.

A means is provided for the utilization of two ropes at the same time.

REFERENCES 1. https://en.wikipedia.org/wiki/Rock-climbing_equipment
2. https://en.wikipedia.org/wiki/Grigri (climbing)
3. http://wiki.risk.ru/index.php/%D0%A1%D0%BF%D1%83%D1%81%D0%BA%D0%BE%D0%B2%D0%BE%D0%B5_%D1%83%D1%81%D1%82%D1%80%D0%BE%D0%B9%D1%81%D1%82%D0%B2%D0%BE
4. http://www.sportx.ru/catalog/promalp/clamps/basic.html

What is claimed is:

1. A rappelling-ascending apparatus for rock-climbing and industrial alpinism, comprising:

an all-metal body, which is defined by a front, a rear, and two lateral sides, a clamping element, and a handle, the all-metal body being made with a widening in a lower portion thereof, a first cut being made in the lateral side lengthwise the widening, a second cut being made in the opposite lateral side lengthwise thereof, the second cut forming flanges on the front and rear sides;

the handle being mounted between the front and rear sides, adapted to be rotatable around an axis, and made spring-biased for the rotation thereof;

the handle comprising a friction fork with two vertical prongs on one side of the handle relative to the axis, the friction fork being located on the side of the first cut, the handle comprising a ring on the opposite side of the handle relative to the axis, the ring being located on the side of the second cut, the clamping element being mounted on the handle facing the flanges and adapted to hold a rope when pressed against the rope passing along the flanges.

2. The apparatus as claimed in claim 1, wherein the clamping element is made with notches facing the rope, the flanges are made with depressions, and the depressions are located opposite the clamping element, whereby the clamping element secures the rope in the depressions.

3. The apparatus as claimed in claim 1, wherein the ring is provided with holes to connect the apparatus to a climber's harness.

4. The apparatus as claimed in claim 1, wherein the body is made with open end faces.

5. The apparatus as claimed in claim 1, wherein a protective coating is applied to the body and the ring.

6. The apparatus as claimed in claim 1, further comprising a fastening element mounted between the front and rear sides adjacent to the axis.

7. A rappelling-ascending apparatus for rock-climbing and industrial alpinism, comprising:

an all-metal body, which is defined by a front, a rear, and two lateral sides, a clamping element, and a handle, the all-metal body being made with a widening in a lower portion thereof, a first cut being made in the lateral side lengthwise the widening, a second cut being made in the opposite lateral side lengthwise thereof, the second cut forming flanges on the front and rear sides;

the handle being mounted between the front and rear sides, being adapted to be rotatable around an axis mounted between the front and rear sides, and being made spring-biased for the rotation thereof;

the handle comprising a friction fork with two vertical prongs on one side of the handle relative to the axis, the friction fork being located on the side of the first cut, the handle comprising a ring on the opposite side of the handle relative to the axis, the ring being located on the side of the second cut, the flanges being made with depressions, the clamping element being mounted on the handle and adapted to hold a rope in the depressions when pressed against the rope passing along the flanges.

8. The apparatus as claimed in claim 7, wherein the ring is provided with holes for snap-hooks.

9. The apparatus as claimed in claim 7, wherein the body is made with open end faces.

10. The apparatus as claimed in claim 7, wherein a protective coating is applied to the body and the ring.

11. A rappelling-ascending apparatus for rock-climbing and industrial alpinism, comprising:

an all-metal body with open end faces, which is defined by a front, a rear, and two lateral sides, a first fastening element located between the front and rear sides, a second fastening element located between the front and rear sides adjacent to the first fastening element, a clamping element, and a handle, the all-metal body being made with a widening in a lower portion thereof, a first cut being made in the lateral side lengthwise the widening, a second cut being made in the opposite lateral side lengthwise thereof, the second cut forming two flanges;

the second fastening element including an axis of the handle with a spring, the handle being mounted on the axis, being spring-biased, and comprising a friction fork with two vertical prongs on one side of the handle relative to the axis, the handle further comprising a ring on the opposite side of the handle from the axis, the ring being located on the side of the second cut, the clamping element being mounted on the handle facing the flanges and adapted to hold a rope when pressed against the rope passing along the flanges.

12. The apparatus as claimed in claim 11, wherein the clamping element is made with notches facing the rope, the flanges are made with depressions, and the depressions are located opposite the clamping element, whereby the clamping element secures the rope in the depressions.

13. The apparatus as claimed in claim 11, wherein the ring is provided with holes for snap-hooks.

14. The apparatus as claimed in claim 11, wherein a protective coating is applied to upper portions of the body and the ring.

15. The apparatus as claimed in claim 11 wherein the first fastening element is provided with a protective cylinder.

* * * * *